US008250875B2

(12) United States Patent
Rafalovich et al.

(10) Patent No.: US 8,250,875 B2
(45) Date of Patent: Aug. 28, 2012

(54) DUAL EVAPORATOR DEFROST SYSTEM FOR AN APPLIANCE

(75) Inventors: Alexander Rafalovich, Louisville, KY (US); Timothy Allen Hamel, Asheville, NC (US)

(73) Assignee: General Electric Company, Schenectady, NY (US)

( * ) Notice: Subject to any disclaimer, the term of this patent is extended or adjusted under 35 U.S.C. 154(b) by 465 days.

(21) Appl. No.: 12/503,984

(22) Filed: Jul. 16, 2009

(65) Prior Publication Data

US 2011/0011109 A1 Jan. 20, 2011

(51) Int. Cl.
*F25B 5/00* (2006.01)

(52) U.S. Cl. ..... 62/196.4; 62/81; 62/151; 62/199

(58) Field of Classification Search ..... 62/81, 151, 62/178, 196.4, 199
See application file for complete search history.

(56) References Cited

U.S. PATENT DOCUMENTS 3,638,444 A * 2/1972 Lindahl ..... 62/81
5,042,267 A 8/1991 Beers et al.
5,465,591 A * 11/1995 Cur et al. ..... 62/439
5,711,159 A 1/1998 Whipple, III
6,705,107 B2 3/2004 Schlosser et al.
7,104,083 B2 9/2006 Dube

* cited by examiner

*Primary Examiner* — Cheryl J Tyler
*Assistant Examiner* — Jonathan Bradford
(74) *Attorney, Agent, or Firm* — Global Patent Operation; Douglas D. Zhang

(57) ABSTRACT

An appliance includes a compression stage, a condensation stage, and an evaporation stage. The evaporation stage includes a first evaporator for a first refrigerated enclosure and a second evaporator for a second refrigerated enclosure. A first valve in a condensation stage bypass line is openable to allow a supply of refrigerant to bypass the condensation stage during a defrost mode, where a condensation stage bypass line is positioned between an output of the compression stage and the second evaporator. A second valve is positioned in a line from the second evaporator to the input to the compression stage and is closeable to block a supply of refrigerant from the second evaporator to the compression stage during the defrost mode. An additional line positioned between the second evaporator and the first evaporator carries the supply of refrigerant from the second evaporator to the first evaporator in the defrost mode.

14 Claims, 4 Drawing Sheets

DUAL EVAPORATOR DEFROST SYSTEM FOR AN APPLIANCE

BACKGROUND OF THE INVENTION

The present disclosure relates generally to refrigerators, and more particularly to a defrost heater system for a refrigerator.

Most refrigerators, such as that as disclosed in U.S. Pat. No. 5,711,159, include an evaporator which normally operates at sub-freezing temperatures in an evaporator compartment positioned behind the freezer compartment. A layer of frost typically builds up on the surface of the evaporator. As disclosed in U.S. Pat. No. 5,042,267, filed on Oct. 5, 1990, and assigned to General Electric Company, assignee of the present invention, a radiant heater is often positioned inside a housing and below the evaporator to warm the evaporator by both convection and radiant heating in order to quickly defrost the evaporator.

However, existing radiant defrost heaters consume a significant amount of energy. Also, radiant defrost heaters typically require a metal enclosure or housing to protect the heating element(s), as well as prevent other objects from contacting the heating element(s). This adds to material, space and cost requirements. Due to the high operating temperatures of radiant defrost heaters, ice in the freezer compartment ice bucket has a tendency to fuse during the defrost process. While some designs to reduce ice fusing can include the use of tubular resistance heaters, these heaters tend to be more expensive than radiant heaters, and still consume a considerable amount of energy. Moreover, they do not lend themselves well to use with some evaporator configurations, such as, for example, spine fin evaporators. For refrigerators that utilize flammable refrigerants, such as for example, isobutene, the use of radiant heaters results in a risk of igniting refrigerant in case of a leak.

Accordingly, it would be desirable to provide an efficient defrost system in a refrigerator that addresses the problems identified above.

BRIEF DESCRIPTION OF THE INVENTION

As described herein, the exemplary embodiments overcome one or more of the above or other disadvantages known in the art.

One aspect of the exemplary embodiments relates to a refrigeration appliance. The refrigeration appliance includes a sealed cooling system that includes a compression stage, a condensation stage, and an evaporation stage. The evaporation stage includes a first evaporator for a first refrigerated enclosure and a second evaporator for a second refrigerated enclosure. A first valve in a condensation stage bypass line is operative to allow a supply of refrigerant to bypass the condensation stage during a defrost mode, where a condensation stage bypass line is positioned between an output of the compression stage and the second evaporator. A second valve is positioned in a line from the second evaporator to the compression stage and is operative to block a supply of refrigerant from the second evaporator to the compression stage during the defrost mode. An additional line positioned between the second evaporator and the first evaporator carries the supply of refrigerant from the second evaporator to the first evaporator in the defrost mode.

Another aspect of the exemplary embodiments relates to a control system for a refrigerator. In one embodiment the control system includes a compression stage, a condensation stage, and an evaporation stage. The evaporation stage includes a first evaporator configured to provide cooling at above freezing temperatures, and a second evaporator configured to provide cooling temperatures below a freezing temperature. A condensation stage bypass line is configured to direct a supply of refrigerant from the compression stage directly to the second evaporator in a defrost mode of the control system. A valve positioned between the second evaporator and the compression stage is configured to block the supply of refrigerant from the second evaporator to the compression stage during the defrost mode, and a line positioned between the second evaporator and the first evaporator is configured to direct the supply of refrigerant from the second evaporator to the first evaporator during the defrost mode.

Still another aspect of the exemplary embodiments relates to a control system for a refrigerator including two independently controllable evaporators. The control system includes a compression stage, a condensation stage and an evaporation stage that includes a first evaporator for refrigerator compartment cooling and a second evaporator for freezer compartment cooling. A condensation stage bypass line is positioned between the compression stage and the second evaporator, the condensation stage bypass line being configured to carry a supply of refrigerant from the compression stage to the second evaporator in a defrost mode of the refrigerator. A line between the second evaporator and the first evaporator is configured to carry the supply of refrigerant from the second evaporator to the first evaporator in the defrost mode.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
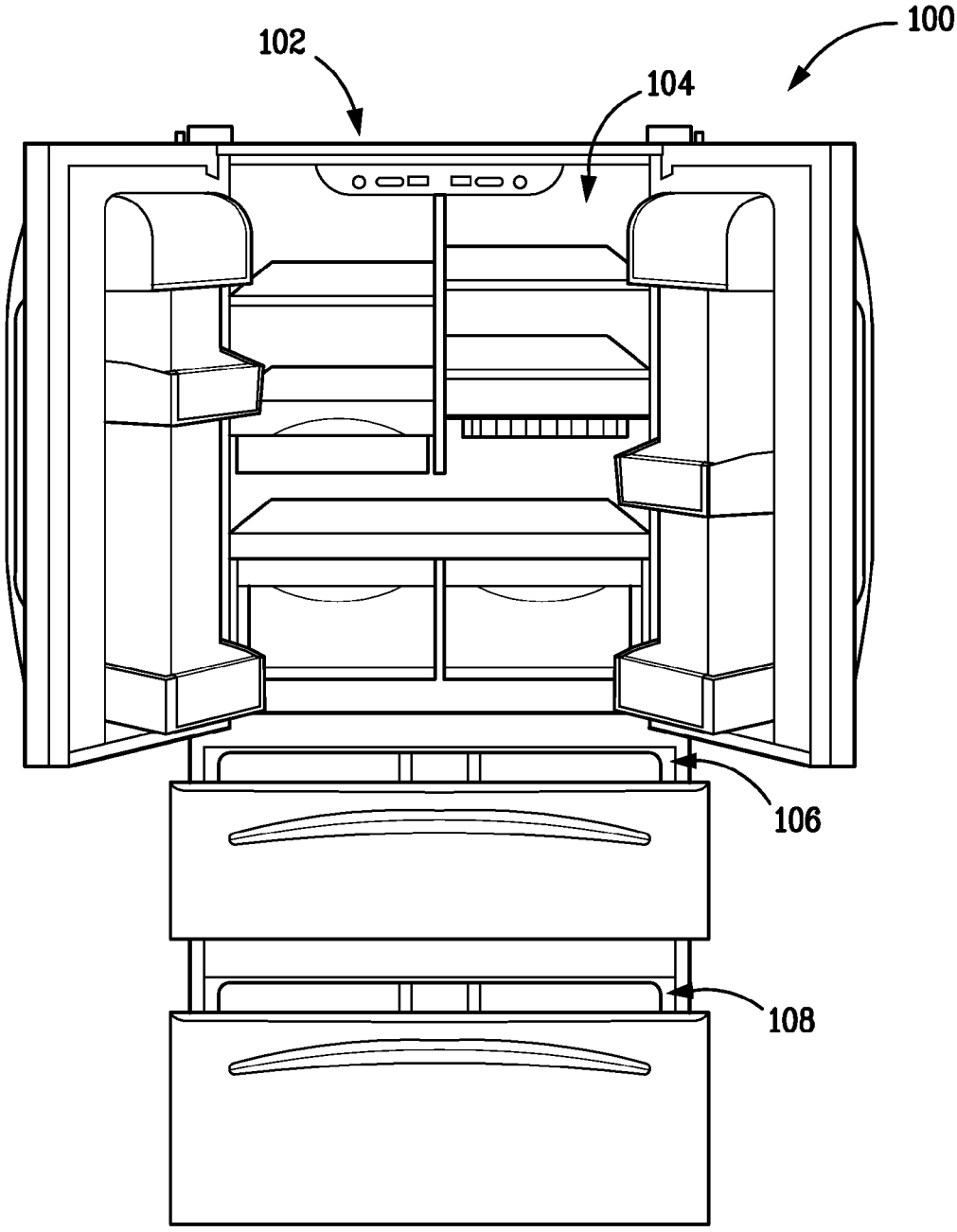
FIG. 1 is a front view, showing a refrigerator according to an exemplary embodiment of the present disclosure, with all of the doors and drawers being opened.

FIG. 1 illustrates an exemplary appliance 100 in accordance with an exemplary embodiment. In this example the appliance 100 is shown as a refrigerator, but in alternate embodiments the appliance may be any suitable appliance that includes refrigeration and freezer compartments.

The aspects of the disclosed embodiments are directed to a sealed refrigeration system that includes two or more evaporators, and where the refrigerator compartment evaporator remains functioning during the defrost cycle. The need for radiant defrost heaters is eliminated by configuring the refrigeration system to deliver compressed refrigerant directly to the freezer compartment evaporator. The compressed refrigerant, which has bypassed the condensing stage, condenses in the freezer compartment evaporator thereby heating the freezer compartment evaporator. The condensed refrigerant exiting the freezer compartment evaporator then flows through the refrigerator compartment evaporator thereby absorbing heat in the other refrigeration compartment(s).

In this regard, the present disclosure is directed to a multi-compartment refrigerator unit 100 that includes at least two compartments within a cabinet structure 102, including, for example, a fresh food compartment and a freezer compartment. The refrigerator unit 100 shown in FIG. 1 includes three compartments, including a first or upper compartment 104, a second or middle compartment 106, and a third or lower compartment 108. In alternate embodiments, the refrigerator unit 100 of the present disclosure can include any suitable number of compartments. One example of a multi-compartment and multi-evaporator refrigerator is described in co-pending U.S. patent application Ser. No. 12/347,284, filed on Dec. 31, 2008, assigned to General Electric Co., the assignee of the instant application, the disclosure of which is incorporated herein by reference in its entirety.

Each of the compartments 104, 106 and 108 can have a desired temperature range. In one embodiment, the upper compartment 104 can be for fresh foods, while the middle compartment 106 is used as a refrigeration compartment or a freezer compartment. The lower compartment 108 may normally function as a freezer compartment. The arrangement, number and type of compartments is not limiting as to the aspects of the present disclosure.

Figure 2A:
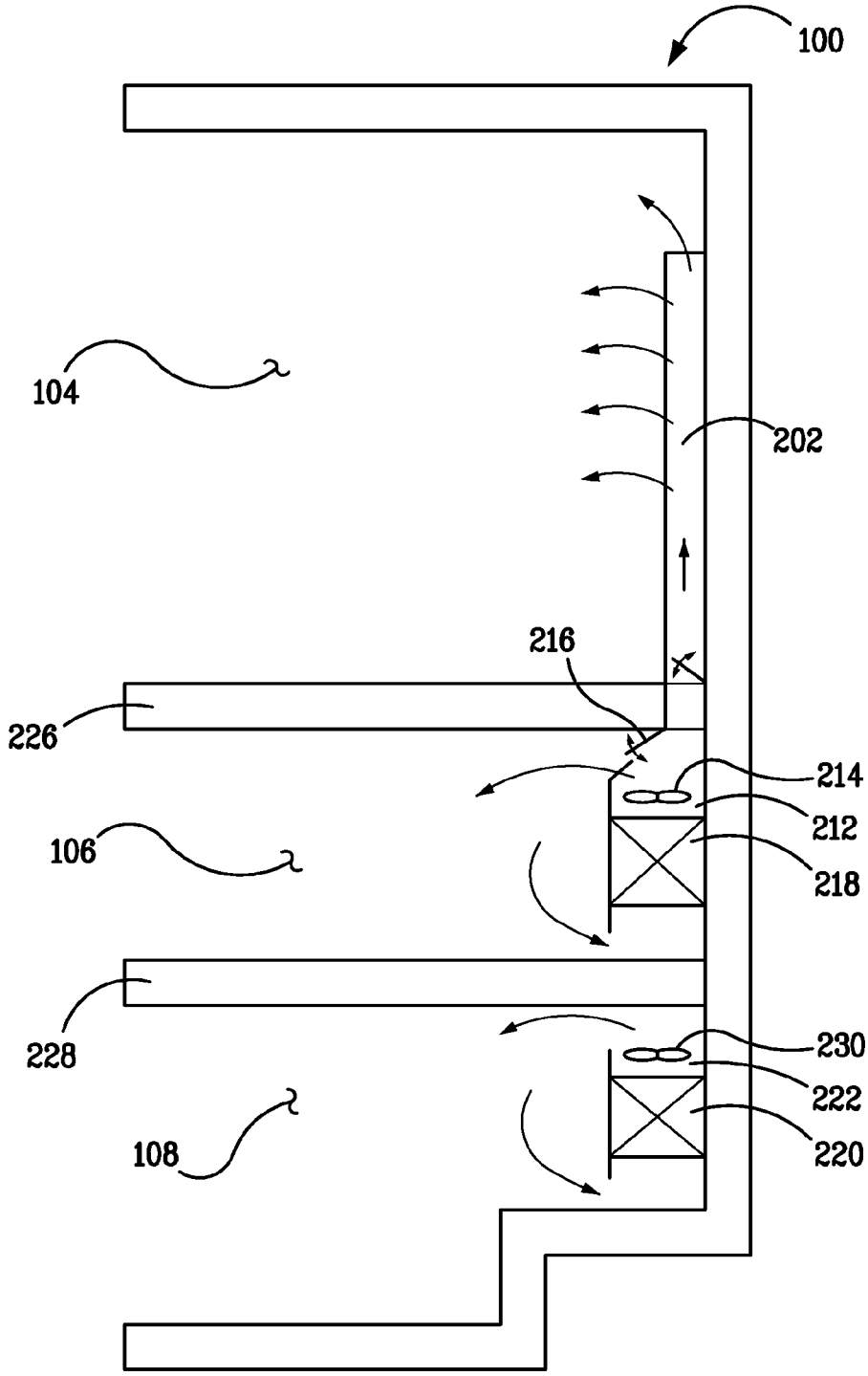
FIG. 2A is a simplified side cross-sectional view of the refrigerator of FIG. 1.

As shown in FIG. 2A, the refrigerator 100 includes upper, middle and lower compartments 104, 106 and 108. A first evaporator 218 is disposed in a sub-compartment 212 that is preferably positioned immediately behind the middle compartment 106, to provide cool air for the compartments 104 and 106. An air tower 202 extends from the sub-compartment 212 to an upper location in the upper compartment 104. The refrigerator 100 also includes a fan 214 in the sub-compartment 212 for circulating or directing the refrigerated air to the middle compartment 106 and to the upper compartment 104 via air tower 202. The refrigerator 100 also includes a damper 216 for controlling the flow of refrigerated air from the sub-compartment 212 to the middle compartment 106.

A second evaporator 220 is disposed in the sub-compartment 222 that is preferably positioned immediately behind the lower compartment 108 for providing cool air for the lower compartment 108. A fan 230 is located in the sub-compartment 222 for circulating or directing the refrigerated air to the lower compartment 108. The evaporators 218, 220 are independent from one another, and one evaporator's temperature can be controlled differently relative to that of the other evaporator by the controller 252 of FIG. 2B to provide different functionality between the middle and lower compartment 106, 108. The evaporators 218, 220 can be operatively connected to a common compressor (not shown), or alternatively, the evaporators 218, 220 can be operatively connected to their respective compressors (not shown), as is known in the art.

A first mullion 226 separates the upper compartment 104 from the middle compartment 106; a second mullion 228 separates the middle compartment 106 from the lower compartment 108.

Figure 2B:
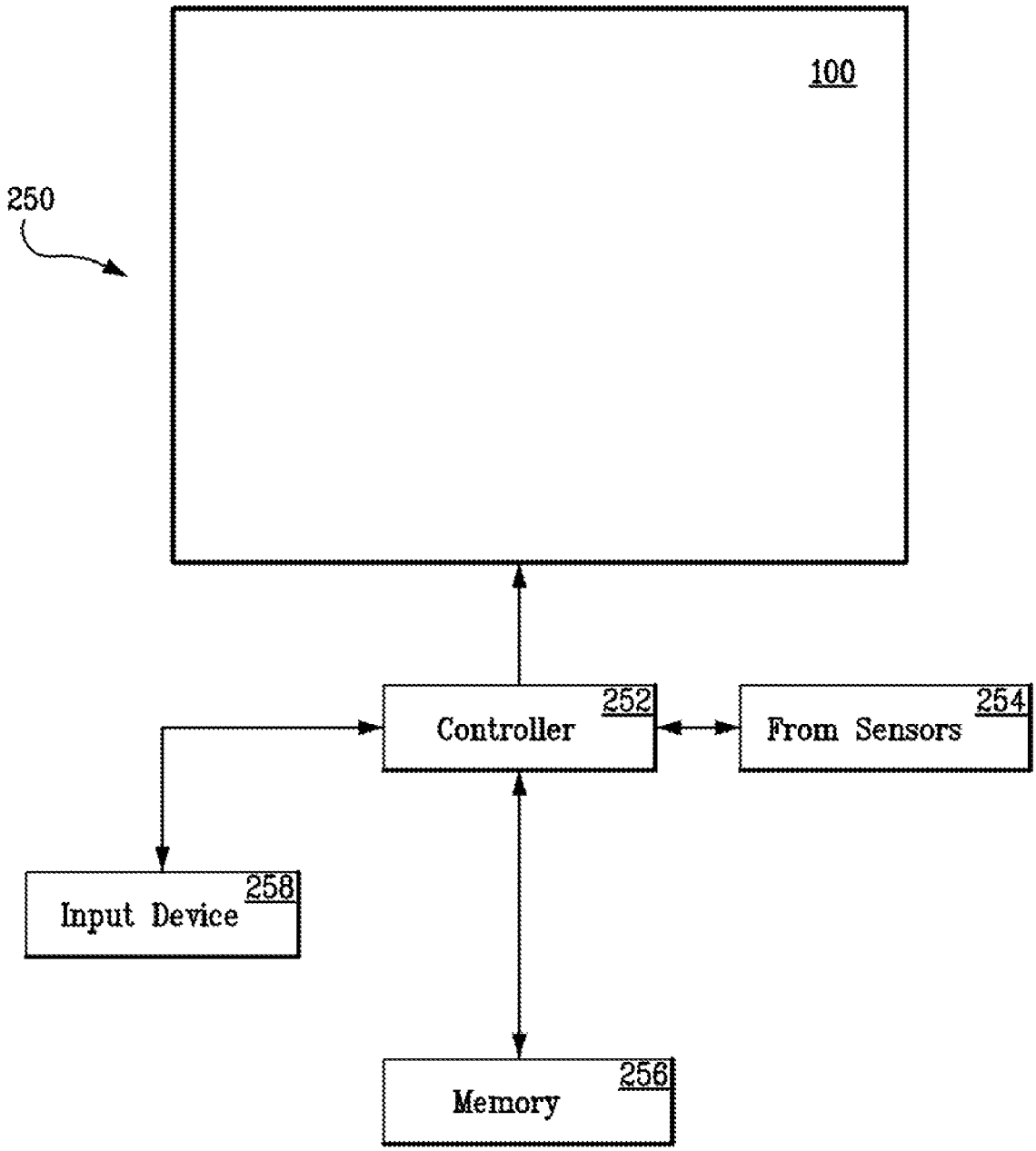
FIG. 2B is a schematic illustration of an exemplary control system for the refrigerator of FIG. 1.

FIG. 2B illustrates an exemplary control system 250 for the refrigerator of the present disclosure. Input device 258 and sensors 254 provide inputs to the controller 252 for controlling the refrigerator, including for example controlling the temperature of the different compartments 104, 106 and 108. FIG. 2B shows that the control system 250 has a memory 256 operatively connected to, or being an integral part of the controller 252. The controller 252 is also operatively connected to the various dampers and sensors 254, such as compartment temperature sensors, ambient condition sensors and compartment access door sensor, so as to allow the controller 252 to determine the cooling demands of respective refrigerator compartments, and generate control signals for the refrigerator 100, including for example, compressor motor speed, evaporator and condenser fan operation and other control functions.

Figure 3:
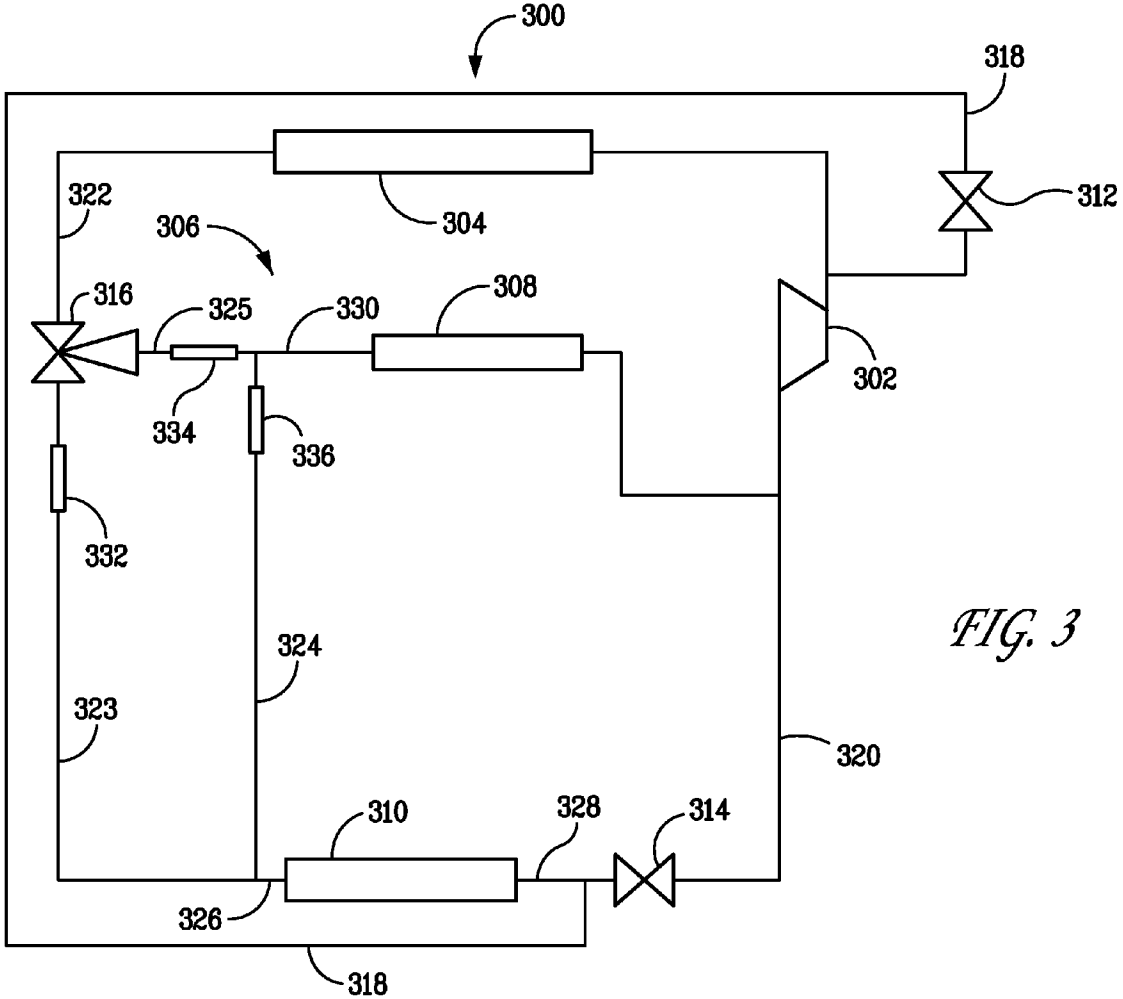
FIG. 3 is a schematic illustration of an exemplary refrigeration system for the refrigerator in FIG. 1.

FIG. 3 illustrates one embodiment of a sealed refrigeration system 300 of the present disclosure for the refrigerator of FIG. 2. As shown in FIG. 3, the refrigeration system 300 includes a compression stage 302, a condensation stage 304, and an evaporation stage 306. The normal operation of each of the stages 302, 304 and 306 is known in the art. In one embodiment, the evaporation stage 306 includes a first evaporator 308 and a second evaporator 310, which correspond to the evaporators designated 218 and 220 respectively in FIG. 2. In alternate embodiments, the evaporation stage can include more than two evaporators. The first evaporator 308 is operable to refrigerate the fresh food compartment(s) 104, 106 of the refrigerator 100, while the second evaporator 310 is operable to maintain the freezer compartment 108 at sub-freezing temperatures.

The refrigeration system 300 of FIG. 3 also includes a first valve 312, a second valve 314 and a third valve 316. The first valve 312 is positioned on bypass line 318 which connects the compression stage 302 directly to the second evaporator 310, bypassing the condensation stage 304. The first valve 312 is operatively configured to allow refrigerant exiting the compression stage 302 to bypass the condensation stage 304 and flow to the second evaporator 310 directly. The second valve 314 is positioned in line 320 from the second evaporator 310 to the compression stage 302. The second valve 314 is operatively configured to block refrigerant flow to the compression stage 302 from the output 328 of the second evaporator 310. The third valve 316, which in the embodiment of FIG. 3 is a three-way valve, is positioned in line 322 from the condensation stage 304 to the evaporation stage 306 and is common to both the first evaporator 308 and the second evaporator 310 via lines 325 and 323, respectively.

An additional line 324 is positioned between the inlet 326 of the second evaporator 310 and the inlet 330 of first evaporator 308. Alternatively, line 318 could be connected to line 323 at the input 326 to evaporator 310 and line 324 could be connected at the output 328 of evaporator 310. Restrictions such as cap tubes 332, 334 and 336 are positioned in lines 323, 324 and 325, respectively.

During a normal refrigeration operating cycle, where both the first evaporator 308 and the second evaporator 310 are providing cooling functions, the first valve 312 is closed and the second valve 314 is open. During this normal refrigeration operating cycle, after the compressed gaseous refrigerant flows out of the compression stage 302, it flows through the condensation stage 304 where it rejects heat to ambient air and liquefies. After the condensation stage 304, the third valve 316 directs the liquid refrigerant either to the first evaporator 308 or the second evaporator 310, or both, depending on the cooling needs of the respective refrigeration/freezer compartments as determined by the controller to provide the required cooling effects and temperature control.

During a defrost cycle, which can be automatically or manually initiated, the first valve 312 is open and second valve 314 is closed. Hot compressed gaseous refrigerant exiting the compression stage 302 bypasses the condensation stage 304 via the bypass line 318 and enters the second or freezer evaporator 310. The second evaporator 310 acts as a condenser in which compressed gaseous refrigerant condenses, rejecting heat. The rejected heat acts to defrost the second evaporator 310, which in these examples, normally provides sub-zero cooling for the freezer compartment 108.

After exiting the second evaporator 310, the now liquid refrigerant enters the first evaporator 308 via the additional line 324. The liquid refrigerant evaporates in the first evaporator 308 and absorbs heat thereby cooling air for the refrigeration compartment 104 and 106 in similar fashion to the refrigeration operating cycle. The refrigerant then returns to the compression stage 302.

Because depending on the cooling capacity required for a particular refrigerator/freezer configuration the internal volume of the second evaporator 310 may be either lower or higher than the internal volume of the condensation stage 304, the cap tube 336 in the additional line 324 may accordingly be more restrictive or less restrictive compared to the cap tube 334 in line 325 for the first evaporator 308.

When initiating the defrost cycle, the three-way third valve 316 is operatively configured to facilitate refrigerant flow from the second evaporator 310 to the first evaporator 308 by blocking flow from the evaporator stage. In this situation, the defrost cycle floods the first evaporator 308 and reduces transition losses when the defrost cycle ends and the regular refrigeration compartment cycle resumes. The defrost cycle may operate each time the third valve 316 directs refrigerant to the first evaporator 308, every other time the first evaporator 308 is on, or any suitable arrangement. In the situation where a transition to the first evaporator 308 is delayed beyond a pre-determined time interval between two consecutive defrost cycles, a new defrost cycle can begin at the end of the time interval.

Thus, the aspects of the disclosed embodiment eliminate the need for additional heating device(s) for the evaporator defrost, such as radiant defrost heaters. Since evaporators in the refrigeration compartments operate above freezing temperatures, no additional or special defrost equipment or cycles are generally needed. The use of two additional shutoff valves to defrost the frozen food compartment evaporator eliminates the need for the additional heating devices, and still allows for refrigeration during the defrost cycle. Each refrigeration cycle is summarized as follows:

During regular freezer compartment cooling, the first valve 312 is in the closed position and the second valve 314 is open. The refrigerant exits the compression stage 302, goes through the condensation stage 304, and into at least the second evaporator 310. The refrigerant then returns back to the compression stage 302.

For refrigerator compartment cooling, the first valve 312 is closed, and the second valve 314 can either be open or closed. The refrigerant exits the compression stage 302 to the condensation stage 304 and then at least to the first evaporator 308. It is noted that the freezer compartment cooling and refrigerator compartment cooling can take place separately or simultaneously, depending on the needs of the system 300. The third valve 316 controls whether the refrigerant from the condensation stage 304 enters one or both of the evaporators 308, 310.

During the defrost mode, the first evaporator 308 continues to provide cooling to the corresponding refrigeration compartment(s) while the refrigerant provides a heating function to the second evaporator 310. In the defrost mode, the first valve 312 is open and the second valve 314 is closed. The second evaporator 310 acts as a condenser and allows the compressed refrigerant from line 318 to expand and condense. The generated heat acts to defrost the second or freezer evaporator 310. The refrigerant passes from the second evaporator 310 to the first evaporator 308, where it absorbs heat and cools the corresponding compartment(s).

The aspects of the disclosed embodiments thus eliminate the need for evaporator radiant defrost heaters. The use of shutoff valves to divert hot gaseous refrigerant after the compression stage into the freezer compartment evaporator provides the required defrost functionality, while still enabling refrigeration of the remaining refrigeration compartments. This provides defrost with much reduced power consumption, limits evaporator surface temperatures to approximately 120° Fahrenheit and delivers less heat to the ice bucket, which reduces the possibility of ice fusing. The elimination of the need for radiant defrost heaters simplifies the evaporator enclosure requirements and eliminates the risk of igniting leaking refrigerant that might otherwise come in contact with the heater element.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a first refrigerated enclosure;

a second refrigerated enclosure;

a compression stage;

a condensation stage;

an evaporation stage comprising:

a first evaporator for the first refrigerated enclosure; and a second evaporator for the second refrigerated enclosure;

a condensation stage bypass line positioned between an output of the compression stage and the second evaporator;

a first valve in the condensation stage bypass line and being operative to allow a supply of refrigerant to bypass the condensation stage during a defrost mode;

a line from the second evaporator to the compression stage;

a second valve positioned in the line from the second evaporator to the compression stage and being operative to block a supply of refrigerant from the second evaporator to the compression stage during the defrost mode;

an additional line positioned between the second evaporator and the first evaporator, the additional line carrying the supply of refrigerant from the second evaporator to the first evaporator in the defrost mode; and a third valve positioned in a line from the condensation stage to the evaporation stage, the third valve being operative to block a supply of refrigerant from the condensation stage to either the first evaporator, the second evaporator or both the first evaporator and the second evaporator, and wherein the third valve is operative to direct refrigerant from the second evaporator to the first evaporator during the defrost mode.

2. The appliance of claim 1, wherein the condensation stage bypass line is positioned between the output of the compression stage and an output of the second evaporator, and the additional line is positioned between an input of the second evaporator and an input of the first evaporator.

3. The appliance of claim 1, wherein the condensation stage bypass line is positioned between the output of the compression stage and an input of the second evaporator, and the additional line is positioned between an output of the second evaporator and an input of the first evaporator.

4. The appliance of claim 1, wherein the second evaporator is configured to provide cooling to sub-freezing temperatures during non-defrost operation.

5. The appliance of claim 1, wherein the first evaporator is configured to provide refrigeration temperatures to the first refrigerated enclosure in the defrost mode.

6. The appliance of claim 1, wherein the appliance comprises a refrigerator.

7. The appliance of claim 1, wherein the first evaporator and the second evaporator are independently controllable.

8. The appliance of claim 1, wherein the third valve comprises a three-way valve.

9. A control system for a refrigerator, comprising:

a compression stage;

a condensation stage;

an evaporation stage comprising:

at least one first evaporator configured to providing cooling at above a freezing temperature; and at least one second evaporator configured to provide cooling temperatures below the freezing temperature;

a condensation stage bypass line configured to direct a supply of refrigerant from the compression stage directly to the at least one second evaporator in a defrost mode of the control system;

a first valve positioned between the at least one second evaporator and the compression stage and being operative to block the supply of refrigerant from the at least one second evaporator to the compression stage during the defrost mode;

a line positioned between the at least one second evaporator and the at least one first evaporator configured to direct the supply of refrigerant to the at least one first evaporator during the defrost mode;

a second valve positioned in the condensation stage bypass line and being operative to allow the supply of refrigerant to flow to the at least one second evaporator during the defrost mode; and a third valve positioned in a line from the condensation stage to the evaporation stage, the third valve being operative to block a supply of refrigerant from the condensation stage to either the first evaporator, the second evaporator or both the first evaporator and the second evaporator, and wherein the third valve is operative to direct refrigerant from the second evaporator to the first evaporator during the defrost mode.

10. The control system of claim 9, further comprising a controller coupled to the first valve and the second valve to control an actuation of each valve to implement the defrost mode.

11. The control system of claim 9, wherein the at least one first evaporator is configured to provide cooling at above the freezing temperature during the defrost mode.

12. The control system of claim 9, wherein the third valve comprises a three-way valve.

13. A control system for a refrigerator including two independently controllable evaporators, comprising:

a compression stage, a condensation stage and an evaporation stage that includes a first evaporator for refrigerator compartment cooling and a second evaporator for freezer compartment cooling;

a condensation stage bypass line positioned between the compression stage and the second evaporator, the condensation stage bypass line being configured to carry a supply of refrigerant from the compression stage to the second evaporator in a defrost mode of the refrigerator;

a line between the second evaporator and the first evaporator and configured to carry the supply of refrigerant from the second evaporator to the first evaporator in the defrost mode;

a valve positioned between the second evaporator and the compression stage, the valve being configured to block the supply of refrigerant to the compression stage from the second evaporator during the defrost mode; and another valve positioned at an output of the condensation stage, the another valve being configured to block a supply of refrigerant to either the first evaporator, the second evaporator or both the first evaporator and the second evaporator, and facilitate refrigerant flow from the second evaporator to the first evaporator during the defrost mode.

14. The control system of claim 13, wherein the another valve comprises a three-way valve.

* * * * *